US011401126B2

(12) United States Patent
Giurlani et al.

(10) Patent No.: US 11,401,126 B2
(45) Date of Patent: Aug. 2, 2022

(54) REWINDING MACHINE FOR PRODUCING PAPER LOGS

(71) Applicant: FUTURA S.P.A., Lu (IT)

(72) Inventors: Giovacchino Giurlani, Capannori (IT); Gabriele Betti, Capannori (IT); Manolo Tamagnini, Porcari (IT)

(73) Assignee: FUTURA S.P.A., Capannori (IT)

( * ) Notice: Subject to any disclaimer, the term of this patent is extended or adjusted under 35 U.S.C. 154(b) by 141 days.

(21) Appl. No.: 17/046,472

(22) PCT Filed: May 21, 2019

(86) PCT No.: PCT/IT2019/050110
§ 371 (c)(1),
(2) Date: Oct. 9, 2020

(87) PCT Pub. No.: WO2019/244182
PCT Pub. Date: Dec. 26, 2019

(65) Prior Publication Data

US 2021/0171306 A1 Jun. 10, 2021

(30) Foreign Application Priority Data

Jun. 19, 2018 (IT) ..... 102018000006447

(51) Int. Cl.
*B65H 26/00* (2006.01)
*B65H 18/14* (2006.01)
*B65H 18/16* (2006.01)

(52) U.S. Cl.
CPC ..... *B65H 26/00* (2013.01); *B65H 18/145* (2013.01); *B65H 18/16* (2013.01);
(Continued)

(58) Field of Classification Search
CPC ..... B65H 26/00; B65H 18/14; B65H 18/145; B65H 18/16; B65H 2408/232;
(Continued)

(56) References Cited

U.S. PATENT DOCUMENTS 5,267,703 A * 12/1993 Biagiotti ..... B65H 18/16 242/541.7
7,198,221 B2 * 4/2007 Betti ..... B65H 19/30 242/534
(Continued)

FOREIGN PATENT DOCUMENTS

EP 0698570 A1 2/1996
EP 1700805 A2 9/2006
(Continued)

OTHER PUBLICATIONS

International Search Report dated Aug. 22, 2019 in corresponding International application No. PCT/IT2019/050110; 4 pages.

*Primary Examiner* — Sang K Kim
(74) *Attorney, Agent, or Firm* — Maier & Maier, PLLC

(57) ABSTRACT

Rewinder for making paper logs, including a winding station with a first winding roller and a second winding roller delimiting a nip and a third winding roller downstream of the other rollers. The rewinder includes optical elements for detecting, at a predetermined time, an actual position of each log in said winding station and an electronic unit connected to the optical elements and programmed to compare the actual position with a theoretical position of the log at the time, the electronic unit being connected to at least one motor driving the rollers and programmed to modify the speed of the at least one motor when a deviation between the actual and theoretical positions exceeds a pre-established value, the electronic unit being also programmed to operate said optical elements at the time.

11 Claims, 4 Drawing Sheets

(52) U.S. Cl.
CPC .... *B65H 2408/232* (2013.01); *B65H 2513/11* (2013.01); *B65H 2557/20* (2013.01)

(58) Field of Classification Search
CPC ..... B65H 2513/11; B65H 2557/20; B65H 19/2269; B65H 2408/235
See application file for complete search history.

(56) References Cited

U.S. PATENT DOCUMENTS

| | | | | |
|---|---|---|---|---|
| 7,931,226 | B2 * | 4/2011 | Benvenuti ..... | B65H 19/2269 242/533.3 |
| 9,079,737 | B2 * | 7/2015 | Gelli ..... | B65H 19/267 |
| 2006/0284000 | A1 | 12/2006 | Dooley et al. | |

FOREIGN PATENT DOCUMENTS

| | | | |
|---|---|---|---|
| JP | 2014213952 | A | 11/2014 |
| WO | 03/076320 | A1 | 9/2003 |

* cited by examiner

REWINDING MACHINE FOR PRODUCING PAPER LOGS

FIELD

The present invention relates to a rewinding machine for producing paper logs.

BACKGROUND

It is known that the production of paper logs, from which for example rolls of toilet paper or rolls of kitchen paper are obtained, involves feeding a paper web, formed by one or more superimposed paper plies, on a predetermined path along which various operations are performed before proceeding to the formation of the logs, including a transverse pre-incision of the web to form pre-cut lines which divide it into separable sheets. The formation of logs normally involves the use of cardboard tubes, commonly called "cores" on the surface of which a predetermined amount of glue is distributed to allow the bonding of the paper web on the cores progressively introduced in the machine that produces the logs. commonly called "rewinder", in which winding rollers are arranged which determine the winding of the web on the cores. The glue is distributed on the cores when they pass along a corresponding path comprising a terminal section commonly called "cradle" due to its concave conformation. Furthermore, the formation of the logs implies the use of winding rollers that provoke the rotation of each core around its longitudinal axis thus determining the winding of the web on the same core. The process ends when a predetermined number of sheets is wound on the core, with the gluing of a flap of the last sheet on the underlying one of the roll thus formed (so-called "flap gluing" operation). Upon reaching the predetermined number of sheets wound on the core, the last sheet of the log being completed is separated from the first sheet of the subsequent log, for example by means of a jet of compressed air directed towards a corresponding pre-cutting line. At this point, the log is unloaded from the rewinder. EP1700805 discloses a rewinding machine which operates according to the above-described operating scheme. The logs thus produced are then conveyed to a buffer magazine which supplies one or more cutting-off machines by means of which the transversal cutting of the logs is carried out to obtain the rolls in the desired length.

SUMMARY

The present invention relates specifically to the control of the position of the logs within the rewinders and aims at providing a control system for the automatic adjustment of the speed of the winding rollers according to the current position of the logs to compensate for possible errors of position due, for example, to the surface wear of the winding rollers and/or the presence of debris on the surface of the winding rollers and/or to the surface characteristics of the paper.

This result has been achieved, in accordance with the present invention, by providing a rewinder having the characteristics indicated in claim 1. Other features of the present invention are the subject of the dependent claims.

Among the advantages offered by the present invention, for example, the following are mentioned: the control of the rewinder is constant over time and does not depend on the experience of operators driving the machines; it is possible to use commercially available optical devices; the cost of the control system is very low in relation to the advantages offered by the invention.

BRIEF DESCRIPTION OF THE DRAWINGS

These and further advantages and features of the present invention will be more and better understood by every person skilled in the art thanks to the following description and the attached drawings, provided by way of example but not to be considered in a limiting sense, in which.

DETAILED DESCRIPTION

Figure 1:
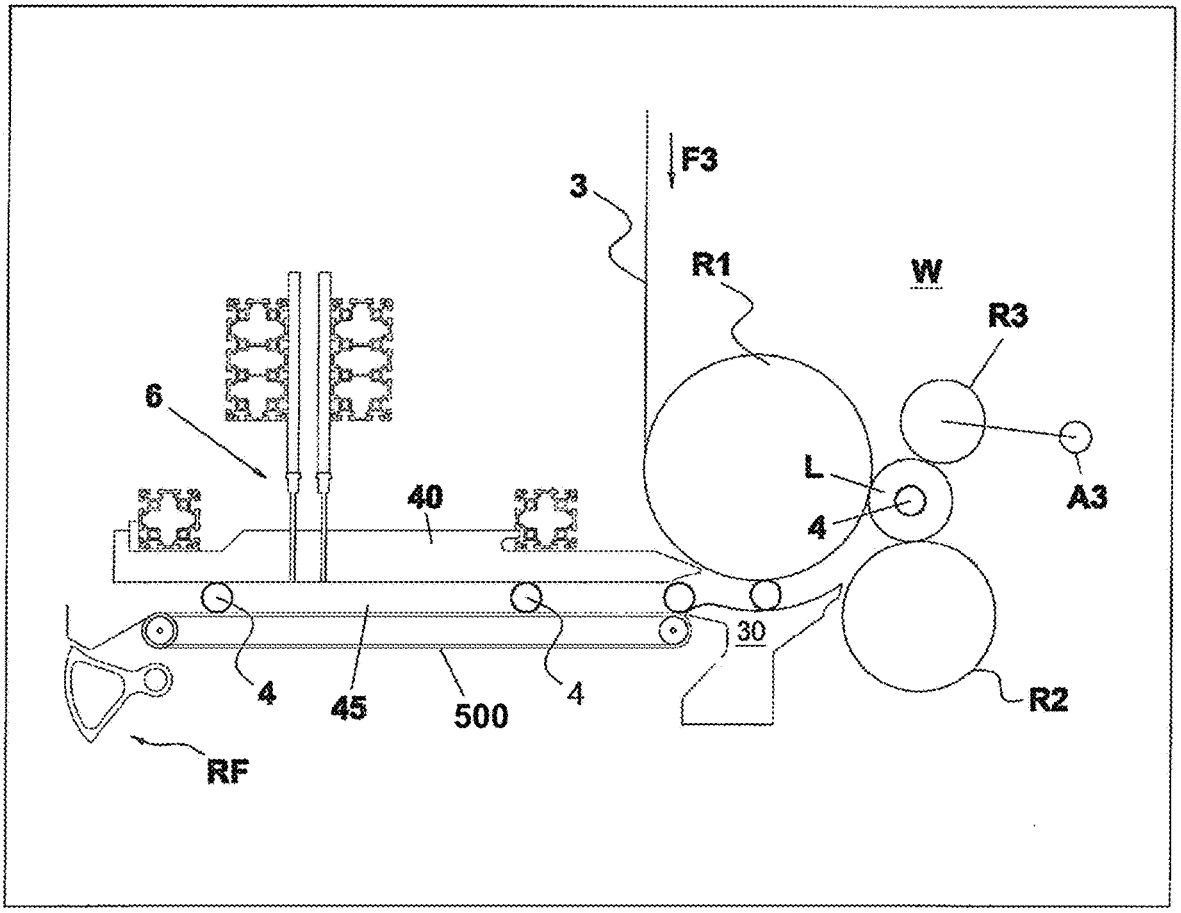
FIG. 1 shows a schematic side view of a rewinder for the production of logs of paper material with a log (L) in the formation phase.
Figure 4:
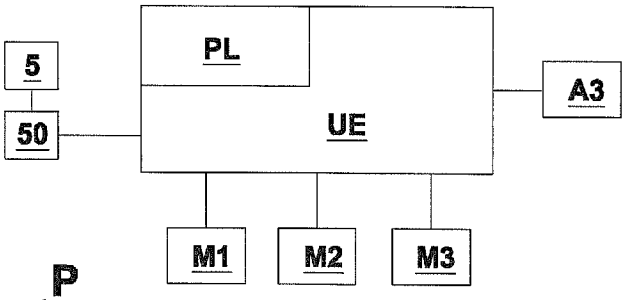
FIG. 4 is a simplified block diagram related to the programmable electronic unit (UE)
Figure 2:
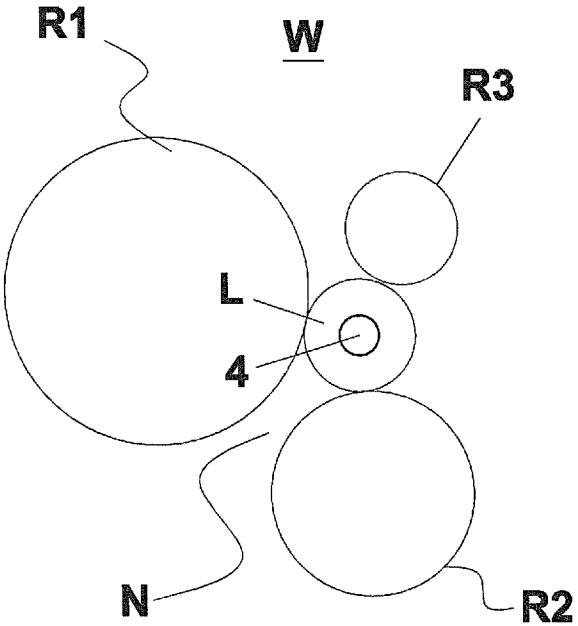
FIG. 2 represents a detail of FIG. 1.
Figure 5:
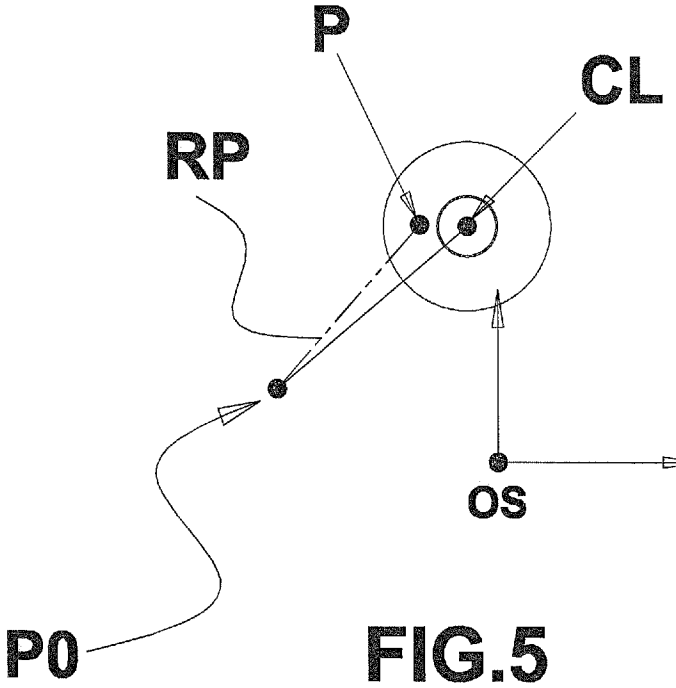
FIG. 5 is a diagram relating to the checks carried out in a rewinder according to the present invention.

A control system according to the present invention is applicable, for example, for controlling the operation of a rewinder (RW) of the type shown in FIG. 1 and FIG. 2. The rewinder comprises a station (W) for winding the paper with a first winding roller (R1) and a second winding roller (R2) apt to delimit, with the respective external surfaces, a nip (N) through which is fed a paper web (3) formed by one or more paper plies and is intended to be wound around a tubular core (4) to form a log (L). The web (3) is provided with a series of transverse incisions which divide the web itself into consecutive individual sheets and facilitate the separation of the individual sheets. The transverse incisions are made in a manner known per se by a pair of pre-cutting rollers arranged along the path followed by the paper web (3) upstream of the winding station (W). Each log (4) consists of a predetermined number of sheets wound around the core (4). During the formation of the log, the diameter of the latter increases up to a maximum value which corresponds to a predetermined length of the web (3), or to a predetermined number of sheets. In the winding station (W) a third winding roller (R3) is provided which, with respect to the direction (F3) followed by the web (3), is arranged downstream of the first and the second winding rollers (R1, R2). Furthermore, the second winding roller (R2) is placed at a lower level than the first winding roller (R1). According to the example shown in the attached drawings, the axes of rotation of the first roller (R1), of the second roller (R2) and of the third roller (R3) are horizontal and parallel to each other, i.e., oriented transversely with respect to the direction followed by the web (3). The third roller (R3) is connected to an actuator (A3) which allows it to be moved from and to the second roller (R2), that is, it allows the third roller (R3)

to be moved from and towards the aforementioned nip (N). Each of said rollers (R1, R2, R3) rotates about its longitudinal axis being connected to a respective drive member (M1, M2, M3). The cores (4) are introduced sequentially into the nip (N) by means of a conveyor that, according to the example shown in FIG. 1, comprises motorized belts (500) arranged underneath fixed plates (40) which in cooperation with the belts (500), force the cores (4) to move by rolling along a straight path (45). The latter develops between a core feeding section, where an introducer (RF) is arranged, and a cradle (30) arranged under the first winding roller (R1). In correspondence with said path (45), nozzles (6) are arranged to supply glue that is applied to each core (4) to allow the first sheet of each new log to adhere to the core (4) itself and to glue the last log sheet on the underlying sheets. The operation of a rewinder of the type described above is known per se.

It is understood that, for the purposes of the present invention, the system for feeding the cores (4) to the winding station (W), as well as the methods and means of dispensing the glue onto the cores (4), can be realized in any other way. The motors (M1, M2, M3) and the actuator (A3) are controlled by a programmable electronic unit (UE) further described below.

Figure 3:
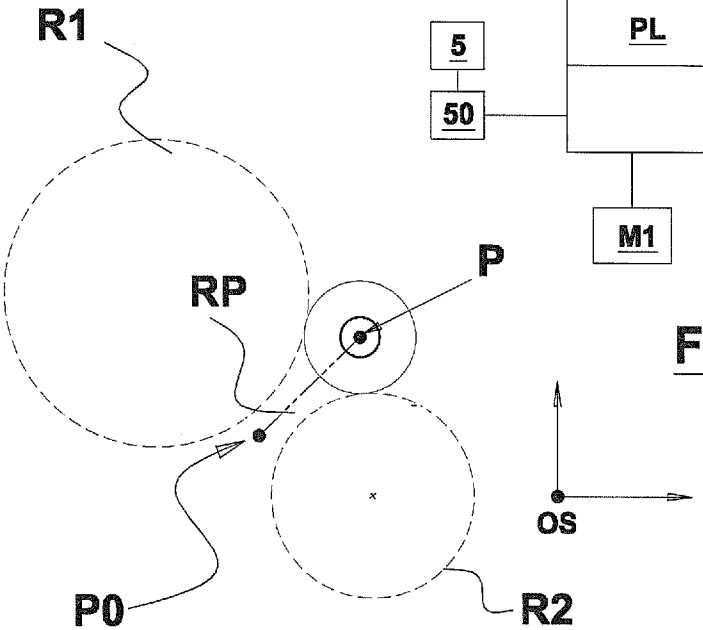
FIG. 3 shows the theoretical positions "P0" and "P" of the axis of a core in the winding station of the rewinder shown in FIG. 1.

Advantageously, in accordance with the present invention, a comparison is made between the actual position of the log being formed in the station (W) at a predetermined time and the position which, at the same time, the log being formed should theoretically occupy along a predetermined path. Possible position errors, corresponding to differences between the actual positions and the theoretical positions exceeding a predetermined limit value, are corrected by modifying the angular speed of one or more of the winding rollers. The theoretical position of the log at each time "t" can be determined, for example, on the basis of the following formula, assuming a straight path (RP) of the cores (4) downstream of the nip (N):

$$P=\tfrac{1}{2}\int_{t0}^{t}(Vp1-Vp2)dt$$

where P is the position of the axis of the core (4) at the time t, t0 is the time of entry of the core (4) into the nip (N), i.e. the time at which the core (4) passes through a predetermined point (P0) of the nip (N), Vp1 is the peripheral speed of the first winder roller (R1) and Vp2 is the peripheral speed of the second winder roller (R2). The position (P) is determined in a predetermined system coordinates. With reference to the described example, said coordinates system is a two-dimensional cartesian system with origin in a predetermined point (OS) in a vertical plane, i.e. a plane orthogonal to the rotation axes of the rollers (R1, R2, R3). For example, the point (OS) is a point spaced by a predetermined value (for example, 200 mm) from the axis of rotation of the second winding roller (R2). For example, the point (OS) is on the right of said axis as shown in FIG. 3. The point (OS) can be, for example, a point belonging to an oscillation axis of the second winding roller (R2) if this latter is a winding roller of the movable type, i.e. of the type moving to and from the upper roller (R1).

The values of t0, Vp1 and Vp2 are known because the time t0 in which the core (4) enters the nip (N) is known, and the external diameters and angular speeds of the rollers (R1) and (R2) are also known. The calculation of the theoretical position (P) of the log is performed by a calculation unit (PL) in which the values of t0, Vp1 and Vp2 are stored or entered.

In order to detect the actual position of the core (4), for example, an optical vision system comprising a camera (5) adapted to take images of the cores (4) in the winding station (W) can be used. The camera (5) is positioned so as to take images of one end of the log being formed. The image of each log (L) detected by the camera (5) therefore corresponds to a two-dimensional shape whose edge is detected by discontinuity analysis of light intensity performed using so-called "edge-detection" algorithms. These algorithms are based on the principle according to which the edge of an image can be considered as the border between two dissimilar regions and essentially the contour of an object corresponds to a sharp change in the levels of luminous intensity. Experimental tests were conducted by the applicant using an OMRON FHSM 02 camera with OMRON FH L 550 controller. The camera (5) is connected with a programmable electronic unit (UE) which receives the signals produced by the same camera. The latter provides the programmable unit (UE) with the center (CL) and the diameter of the log in said coordinates system. In this example, said controller (50) is programmed to calculate the equation of a circumference passing through three—preferably four—points (H) of the edge (EL) detected as previously mentioned and to calculate its center (CL). The position of the center (CL) thus calculated is considered the actual position of the log (L) in the winding station (W). For example, said time "t" is the time when the actuator (A3) has completed the descent of the roller (R3). This time "t" is a known data.

Figure 6:
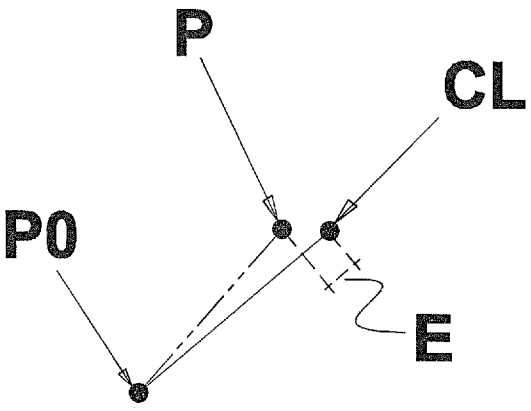
FIG. 6 is a diagram relating to the checks carried out in a rewinder according to the present invention.
Figure 7:
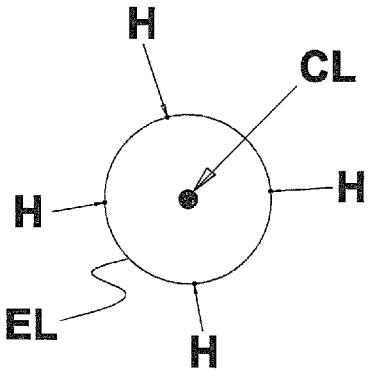
FIG. 7 is a diagram relating to the checks carried out in a rewinder according to the present invention.

The unit (UE) compares the theoretical position (P) of the axis of the core calculated by the calculation unit (PL) determining, in value and sign, the deviation (E) between the value (P) and the value (CL). In particular, the unit (UE) calculates the length of the segment CL-P0 and the length of the segment P-P0. The deviation (E) is the difference, in value and sign, of these lengths. The deviation (E), if different from zero, represents an error in the position of the log in formation with respect to the position (P) which it should theoretically occupy in the chosen reference system. If the error (E) exceeds a predetermined limit value, the unit (UE) commands a variation of the relative speed between the rollers (R1) and (R2) to bring the error (E) back to a value lower than the limit value preset. If the error is positive (the actual position of the log L is advanced in relation to the theoretical position, as schematically shown in FIG. 6), the relative speed between the rollers R1, R2 is decreased. On the contrary, if said error is negative (the actual position of the log L is behind the theoretical position), the relative speed between the rollers R1, R2 is increased. For example, the angular speed of the roller alone (R2) can be modified. Thus, for example, if the error (E) is positive, the angular speed of the roller (R2) is increased; and if the error (E) is negative, the angular speed of the roller (R2) is decreased.

The increase or decrease of the angular speed of the roller (R2) can be predetermined according to the absolute value of the error (E). For example, if E>5 mm, the increase or decrease of the angular speed of the roller (R2) can be 0.3%. Furthermore, for example, if E≤5 mm, the increase or decrease of the angular speed of the roller (R2) can be 0.1%.

Preferably, the value (E) is given by the arithmetic average of the values of the errors detected in a predetermined number "n" of consecutive detections of the actual position of the logs L (for example n=5) so that the corrective action consisting in modifying the relative speed of the rollers (R1, R2) is implemented after the execution of said "n" detections. In other words, preferably, the relative speed between the rollers (R1, R2) is not changed instantaneously but after a predetermined number "n" of consecutive detections of the actual position of the logs L. The aforementioned optical system can also be used to automatically adjust the phase of expulsion of the completed logs.

Also in this case a comparison is made between the position that each log should theoretically occupy along a predetermined path and the actual position of the log. The predetermined path is, also in this case, a straight path that develops between the position occupied by the axis of the log at the end of the winding phase (position occupied at time t0') and the position occupied by the same axis at a next time t' (position occupied after a time corresponding to the winding of a predetermined amount of paper, for example 300 mm).

The theoretical position of the log in the phase of expulsion at the generic time t' is given by the following formula, assuming a straight path (EP) followed by the cores (4):

$$P'=\tfrac{1}{2}\int_{t0'}^{t'}(Vp3-Vp2)dt$$

where P' is the position of the axis of the core (4) at the time t', t0' is the time of the end of the winding phase, i.e. the time at which the winding of the paperweb on the core (4) is completed, Vp3 is the peripheral speed of the third winder roller (R3) and Vp2 is the peripheral speed of the second winder roller (R2). The position P' is calculated in the aforementioned coordinate system. The values of t0', Vp3 and Vp2 are known because the time t0' corresponds to the time in which the winding of a predetermined amount of paper on the core (4) is completed, which is a known datum, and the external diameters and angular speeds of the rollers (R3) and (R2) are also known. The calculation of the theoretical position (P) of the log is performed by the aforementioned calculation unit (PL).

Figure 10:
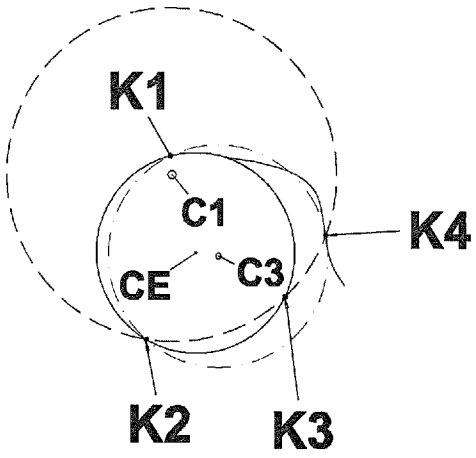
FIG. 10 is a diagram relating to the checks carried out in a rewinder according to the present invention.
Figure 9:
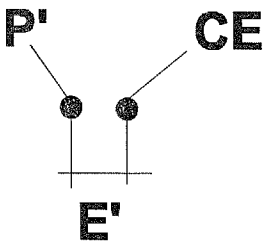
FIG. 9 is a diagram relating to the checks carried out in a rewinder according to the present invention.
Figure 8:
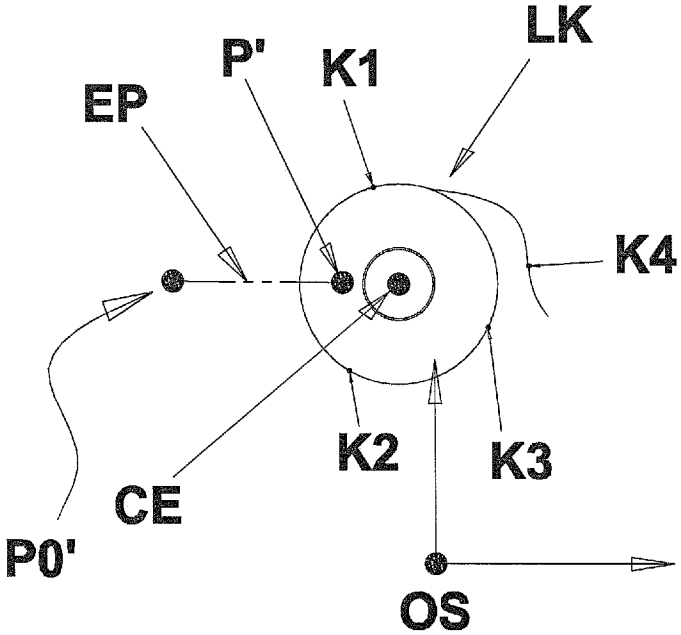
FIG. 8 is a diagram relating to the checks carried out in a rewinder according to the present invention.

In this phase, the images produced by the camera (5) are processed as previously mentioned to detect the edge of an end of the completed log (LK). The controller (50) associated with the camera (5) is programmed to calculate the equations of the three circumferences passing through three points of a set of four points (K1, K2, K3, K4) of the edge detected as previously mentioned and to calculate the center (C1, C2, C3) of each circumference in the aforementioned coordinate system. In accordance with the invention, the controller (50) is programmed to assume as the effective center (CE) only that of the circumference of smaller diameter among all said circumferences. In the diagram in FIG. 10, the circumference drawn with a solid line is the circumference with the smallest diameter (center CE), the circumference drawn with a dash-and-dot line is the circumference with an intermediate diameter (center C3), and the circumference drawn with dashed line is the circumference of maximum diameter (center C1). In the diagrams of FIG. 8 and FIG. 10 the point "K4" is a point of the final edge of the log that in general could be distanced from the rest of the log. The programmable electronic unit (UE) calculates the difference (E') between the lengths of the segments P0'-CE and P0'-P' and consequently detects any deviations, or errors, in value and sign. If the error is positive (position of the log advanced with respect to the theoretical position) the angular speed of the third winder roller (R3) is reduced. Conversely, if the error is negative (actual position of the log behind the theoretical position) the angular speed of the third winding roller (R3) is increased. Also in this case, the increase or decrease of the angular speed of the roller (R3) can be predetermined according to the absolute value of the error (E'). For example, if E'>5 mm, the increase or decrease of the angular speed of the roller (R3) can be 0.3%. Furthermore, for example, if E'≤5 mm, the increase or decrease of the angular speed of the roller (R3) can be 0.1%.

Preferably, also in this case the value (E) is given by the arithmetic average of the values of the errors detected in a predetermined number "n" of consecutive detections of the actual position of the logs L (for example n=5) and the corrective action consisting in modifying the relative speed of the rollers (R2, R3) is implemented after the execution of said "n" measurements. In other words, preferably, the relative speed between the rollers (R2, R3) is not changed instantaneously but after a predetermined number "n" of consecutive detections of the actual position of the logs L.

Therefore, a rewinder according to the present invention is characterized by optical means (5, 50) capable of detecting, at a predetermined detection time, an actual position of each log in said winding station (W) and a programmable electronic unit (UE) which is connected to said optical means (5, 50) and is programmed to compare said actual position with a predetermined theoretical position of the log at said detection time, said electronic unit (UE) being connected to at least one of said electric motors (M1; M2; M3) and being also programmed to modify the angular speed of said at least one electric motor (M1; M2; M3) when a deviation (E; E') between said actual position and said theoretical position exceeds a pre-established value, the angular speed of said at least one electric motor (M1; M2; M3) is increased or decreased depending on the sign, positive or negative, of said deviation (E; E'), said electronic unit being also programmed to operate said optical means at said detection time.

In accordance with the present invention, said electronic (UE) unit can be programmed to progressively modify the angular speed of said at least one electric motor (M1; M2; M3) when a deviation between said actual position and said theoretical position exceeds a pre-established value.

Furthermore, said electronic unit (UE) can be programmed to change the angular speed of the motor (M2) driving the second winding roller (R2), or it can be programmed to modify the angular speed of the motor (M3) driving the third roller (R3).

According to the present invention, the deviation between the actual position and the theoretical position of the log is detected during a phase of expulsion of the log from the winding station (W) or a log formation phase.

According to the present invention, said electronic unit (UE) is programmed to modify by a predetermined value the angular speed of said at least one electric motor (M1; M2; M3) according to the value of the deviation (E, E') between said actual position and said theoretical position.

In practice, the details of execution can in any case vary in an equivalent manner as regards the individual elements as described and illustrated and their mutual arrangement without departing from the scope of the adopted technical and therefore remaining within the limits of the protection conferred by the present patent according to the appended claims.

The invention claimed is:

1. A rewinder for the production of logs of paper material comprising:

a winding station for winding the paper material with a first winding roller and a second winding roller, delimiting, with their respective external surfaces, a nip through which a paper web comprising one or more paper plies is fed and wound in said winding station to produce logs, and a third winding roller which, in relation to a direction from which the paper web is fed, is positioned downstream of the first winding roller and the second winding rollers, wherein the second winding roller is positioned at a lower level than the first winding roller, the axes of rotation of the first winding roller, the second winding roller and the third winding roller are horizontal and parallel to each other such that they are oriented transversely to the direction from which the paper web is fed, the third winding roller is connected to an actuator which allows it to be moved cyclically from and to the nip so that the position of the third winding roller varies in relation to the other two winding rollers during the production of the logs, and wherein each of the said winding rollers rotates around its own axis being connected to a corresponding electric motor, and further comprising optical vision system capable of detecting, at a predetermined detection time, an actual position of each log in said winding station and an electronic unit which is connected to said optical vision system and is programmed to compare said actual position with a predetermined theoretical position of the logs at said detection time, said electronic unit being connected to at least one electric motor and being also programmed to modify an angular speed of said at least one electric motor when a deviation between said actual position and said theoretical position exceeds a pre-established value, the angular speed of said at least one electric motor is increased or decreased depending on a sign, positive or negative, of said deviation, said electronic unit being also programmed to operate said optical vision system at said detection time.

2. The rewinder according to claim 1, wherein said electronic unit is programmed to progressively modify the angular speed of said at least one electric motor when the deviation between said actual position and said theoretical position exceeds a pre-established value.

3. The rewinder according to claim 1, wherein said electronic unit is programmed to change an angular speed of a motor driving the second winding roller.

4. The rewinder according to claim 1, wherein said electronic unit is programmed to change an angular speed of a motor driving the third winding roller.

5. The rewinder according to claim 1, wherein the deviation between the actual position and the theoretical position of the logs is detected during a log formation phase.

6. The rewinder according to claim 1, wherein the deviation between the actual position and the theoretical position of the logs is detected in a phase of expulsion of the logs from the winding station.

7. The rewinder according to claim 1, wherein said electronic unit is programmed to modify, by a predetermined value, the angular speed of said at least one electric motor according to the value of the deviation between said effective position and said theoretical position.

8. The rewinder according to claim 1, wherein said electronic unit is programmed to modify by 0.3% the angular speed of said at least one electric motor when the deviation between said actual position and said theoretical position exceeds 5 mm.

9. The rewinder according to claim 1, wherein said electronic unit is programmed to modify by 0.1% the angular speed of said at least one electric motor when the deviation between said actual position and said theoretical position is different from zero and is less than 5 mm.

10. The rewinder according to claim 1, wherein the deviation corresponds to an average value of deviations detected in a predetermined number of detections.

11. The rewinder according to claim 10, wherein said predetermined number of detections is five.

* * * * *